US009352586B2

(12) United States Patent
Perret et al.

(10) Patent No.: US 9,352,586 B2
(45) Date of Patent: May 31, 2016

(54) METHOD AND DEVICE FOR PRINTING PATTERNS ONTO THREE-DIMENSIONAL ARTICLES

(71) Applicants: Jean-Luc Perret, Arbent (FR); Jean-Pierre Rousselet, Oyonnax (FR)

(72) Inventors: Jean-Luc Perret, Arbent (FR); Jean-Pierre Rousselet, Oyonnax (FR)

( * ) Notice: Subject to any disclaimer, the term of this patent is extended or adjusted under 35 U.S.C. 154(b) by 0 days.

(21) Appl. No.: 14/409,774

(22) PCT Filed: Jun. 17, 2013

(86) PCT No.: PCT/FR2013/000154

§ 371 (c)(1),
(2) Date: Dec. 19, 2014

(87) PCT Pub. No.: WO2013/190190

PCT Pub. Date: Dec. 27, 2013

(65) Prior Publication Data

US 2015/0132490 A1 May 14, 2015

(30) Foreign Application Priority Data

Jun. 19, 2012 (FR) ..... 12 01742

(51) Int. Cl.
*B41J 3/00* (2006.01)
*B41J 3/407* (2006.01)
*B41J 11/00* (2006.01)

(52) U.S. Cl.
CPC ..... *B41J 3/4073* (2013.01); *B41J 3/00* (2013.01); *B41J 11/008* (2013.01)

(58) Field of Classification Search
CPC ..... B41J 3/4073
See application file for complete search history.

(56) References Cited

U.S. PATENT DOCUMENTS

| | | | | | |
|---|---|---|---|---|---|
| 3,627,908 | A * | 12/1971 | Dailey | H04N 1/6016 | 250/549 |
| 4,931,860 | A * | 6/1990 | Narumiya | H04N 1/46 | 347/3 |
| 5,139,337 | A * | 8/1992 | Fischer | B65H 5/00 | 226/162 |
| 6,638,440 | B1 * | 10/2003 | Grimard | B41J 2/442 | 216/31 |
| 7,709,048 | B2 * | 5/2010 | Teichman | A61F 2/82 | 118/669 |
| 2006/0137548 | A1 * | 6/2006 | Vetter | B41F 17/22 | 101/38.1 |
| 2010/0183822 | A1 * | 7/2010 | Ruggie | B41J 3/407 | 427/555 |
| 2012/0098914 | A1 * | 4/2012 | Dubuit | B41J 3/4073 | 347/104 |

FOREIGN PATENT DOCUMENTS

| | | | | |
|---|---|---|---|---|
| EP | 2189292 | A1 * | 5/2010 | B41J 11/425 |
| FR | WO 2011154628 | A1 * | 12/2011 | B41J 3/4073 |
| GB | 2 376 920 | A | 12/2002 | |

* cited by examiner

*Primary Examiner* — Cachet Sellman
(74) *Attorney, Agent, or Firm* — Oliff PLC

(57) ABSTRACT

Method for printing patterns onto three-dimensional articles mounted respectively on rotary receiving elements, including a step of generating, for each receiving element, a set of several digital images for respectively printing parts of a same pattern onto an article mounted on the receiving element, a step of printing successively parts of a same pattern onto a same article respectively from the digital images of the set associated with the receiving element for the article, the digital images of a same set having a same length, and a step of printing simultaneously several parts of distinct patterns respectively onto several articles, each simultaneous printing of a part of a pattern onto an article being performed from a digital image of the set associated with the receiving element for the article.

7 Claims, 5 Drawing Sheets

METHOD AND DEVICE FOR PRINTING PATTERNS ONTO THREE-DIMENSIONAL ARTICLES

TECHNICAL FIELD OF THE INVENTION

The invention relates to the printing of patterns onto three-dimensional articles, and more particularly the printing on articles mounted on rotary receiving elements.

STATE OF THE ART

The flaks, tubes, pots used for the ink jet printing are generally made out of plastic, because they are in particular very cheap, unbreakable, light, and colorable. Flasks can also be made out of glass.

In order to print a pattern, in particular a colored one, onto a plastic article, one preferably starts with subjecting the surface to be printed to a treatment, for example a corona, flame or plasma treatment, or any suitable surface treatment, in order to provide the surface with a better ink adherence. A white background may then be printed and caused to dry, for example by means of ultraviolet radiations, before printing a pattern thereon by using a four-color printing process (black, magenta, cyan, yellow). Printing machines are generally used which include several fixed ink jet print heads, and an article is moved relative to the heads. The machines include a driving mechanism for rotating the articles in order to print a pattern. Whatever the printing device used, printing defects can occur because of the errors generated by the displacement of the article or the print heads. Indeed, when the article rotates at a higher speed than expected, in particular due to the variations in the operation of the driving mechanism, the pattern is spread out over the article. It is then said that there is a layout error of the pattern on the article. The defects of printing machines, small though they may be, added to one another, lead to variations in the position of the article relative to the print heads, and in layouts, which are incompatible with the extreme precision required for a high quality printing. Moreover, the high printing speed in an industrial environment imposes repeated printings and quickly leads to printing defects. In addition, these machines are complex and require maintenance and adjustment operations which can be time-consuming and can reduce the printing speed for the patterns.

One can quote for example British patent application GB 2376920 which discloses a process for printing a pattern onto a cylinder (or cone) of unspecified size by means of several print heads. The print heads are arranged radially relative to the center of the article so as to print onto curved objects. The print heads can be fixed or mobile along an axis. For example, the cylinder is rotated around its axis while a print head is translated along a generating line of the cylinder. In other words, the relative trajectory of the print head with respect to the cylinder has an helical shape. In addition, a printing software takes the parameters of the helical line into account for correcting the printed image. The software can implement an image processing for printing for example a rectangular image onto a conical article. The software uses a print file modified so as to adapt the rectangular image to the conical article. But this method enables to print only one pattern onto only one object at once and is unsuitable for an industrial process in which one wishes to print several patterns onto several articles at a high printing speed.

OBJECT OF THE INVENTION

An object of the invention is to solve these disadvantages, and more particularly to provide a means for printing patterns at a high printing speed and with a high precision.

Another object is to provide a means for correcting the printing errors due to, in particular, pattern layout variations.

According to an aspect of the invention, it is proposed a method for printing patterns onto three-dimensional articles respectively mounted on rotary receiving elements, including a step of generating, for each receiving element, a set of several digital images for respectively printing parts of a same pattern onto an article mounted on the receiving element, and a step of printing successively parts of a same pattern onto a same article respectively from the digital images of the set associated with the receiving element for the article.

The digital images of a same set have a same length, the method including a step of printing simultaneously several parts of distinct patterns respectively onto several articles, each simultaneous printing of a part of a pattern onto an article being performed from a digital image of the set associated with the receiving element for the article.

Such a method enables to increase the speed of printing patterns onto several articles. Moreover, the length of the digital images associated with each receiving element is adapted in order to obtain a precise printing of the patterns. Thus, several patterns are printed onto various articles at a high printing speed while guaranteeing a high precision of pattern printing.

Each digital image can represent a monochromatic part of a pattern.

The length of the digital images of a same set associated with a receiving element can be determined from the length of an arc described by the rotation of the article mounted on the receiving element.

Thus, the differences in rotation between the receiving elements are taken into account in order to print patterns onto articles with an even higher precision. Indeed, there can be variations in rotation between two receiving elements due to a machining defect of the elements, or to a positioning error of the elements. Thus, the printing of patterns is adapted according to the variations in rotation between two receiving elements.

According to another aspect of the invention, it is proposed a device for printing patterns onto three-dimensional articles including:

- a printing station provided with several ink jet print heads;
- a support plate provided on its periphery with a plurality of receiving elements for articles, each receiving element being rotatingly mounted on the support plate;
- image processing means configured to generate, for each receiving element, a set of several digital images for respectively printing parts of a same pattern onto an article mounted on the receiving element; and
- means for rotating the support plate configured to place each article mounted on a receiving element successively opposite each print head so as to print successively the parts of a same pattern onto a same article respectively from the digital images of the set associated with the receiving element for the article.

The digital images of a same set have a same length, and the print heads are configured to print simultaneously several parts of distinct patterns respectively onto several articles, each print head printing a part of a pattern onto an article from a digital image of the set associated with the receiving element for the article.

The image processing means can generate monochromatic digital images.

The image processing means can determine the length of the digital images of a same set associated with a receiving element from the length of an arc described by the rotation of the article mounted on the receiving element.

BRIEF DESCRIPTION OF THE DRAWINGS

Other advantages and features will more clearly arise from the following description of particular embodiments of the invention given as nonrestrictive examples and represented in the annexed drawings, in which.

DETAILED DESCRIPTION

Figure 1:
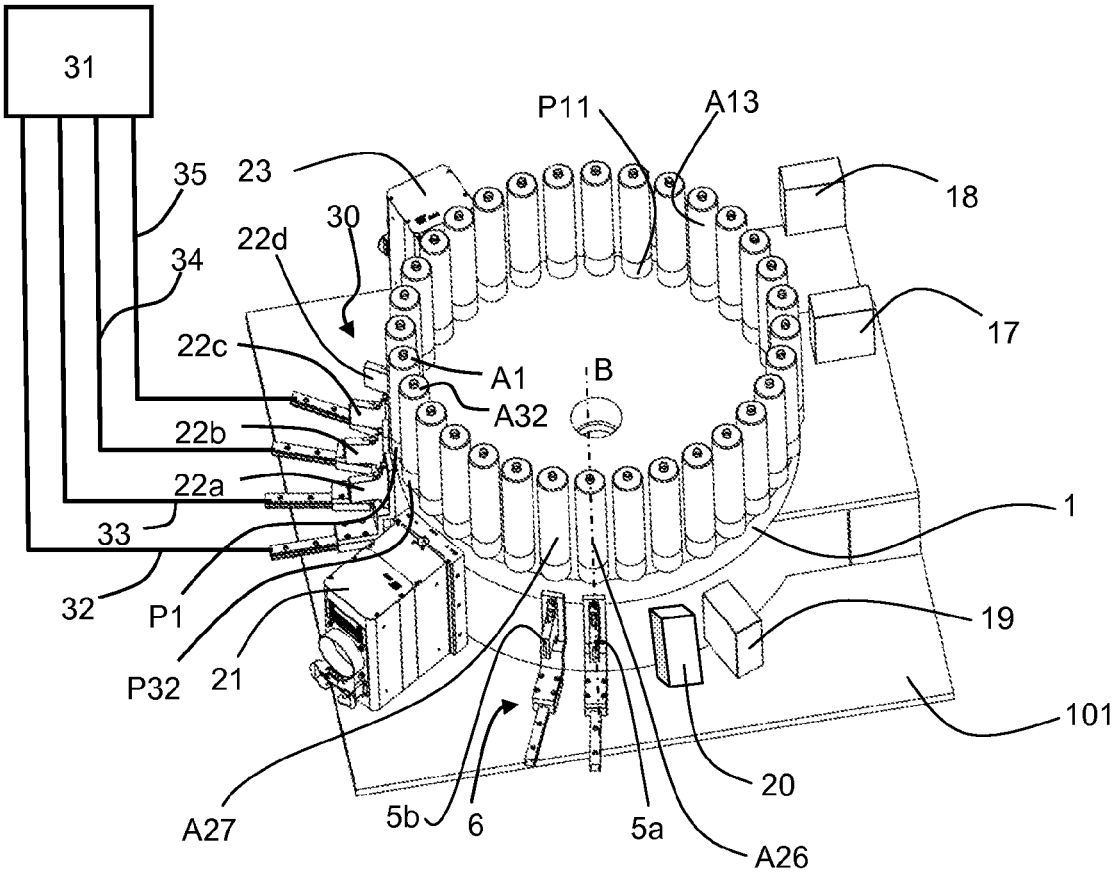
FIG. 1 schematically illustrates a perspective view of an embodiment of a printing device according to the invention.

FIG. 1 schematically represents an embodiment of a printing device for printing onto three-dimensional articles A1 to A32, which makes it possible to a precise printing at a high printing speed.

The articles A1 to A32 can have a general cylindrical shape (for example flasks, bottles, pots, etc). The shape of an article A1 to A32 can be slightly different from that of a cylinder; it can be slightly conical (for example goblets), concave, or convex. It can also have an elliptic or ovoid section.

Figure 2:
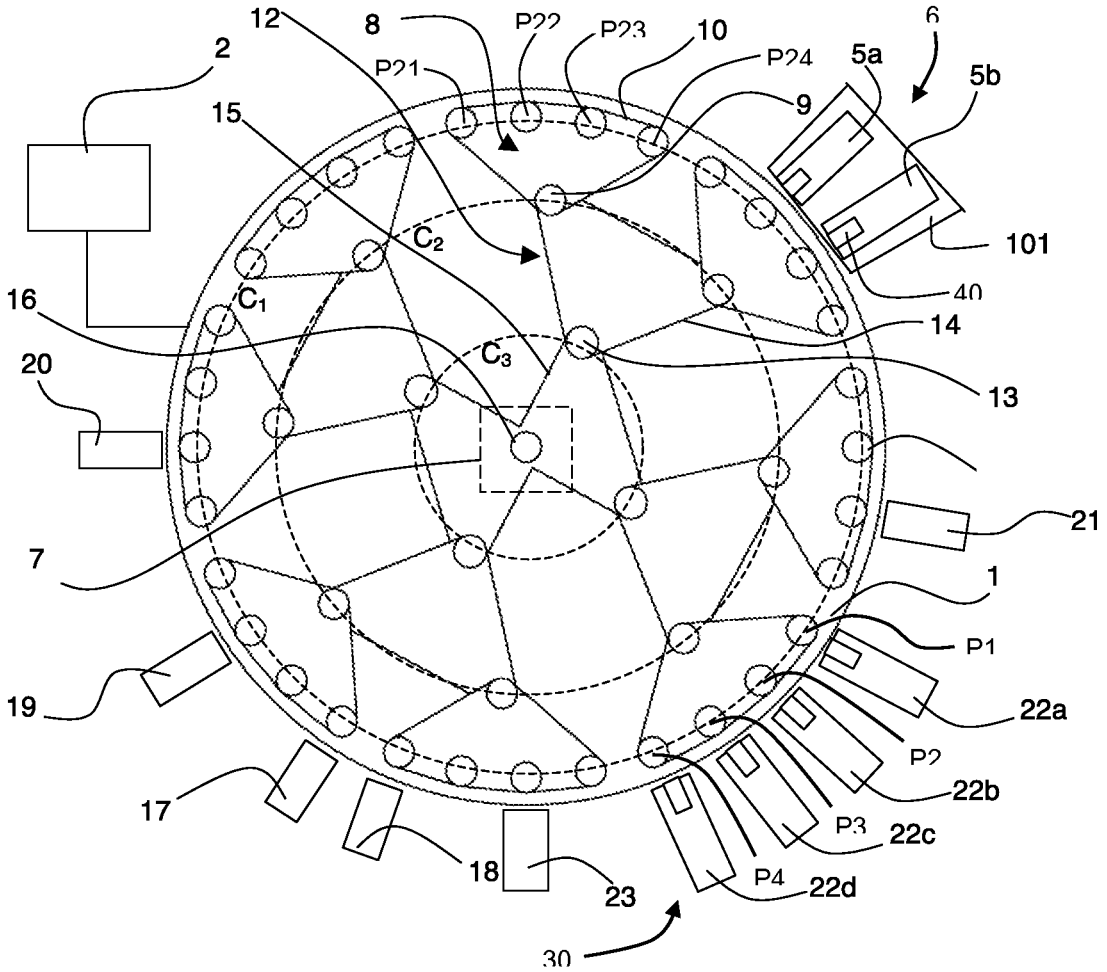
FIG. 2 schematically illustrates a top view of the printing device in FIG. 1.

The printing device comprises a support plate 1. This support plate 1 can be rotated around an axis substantially perpendicular to the plane of the plate, by rotating means such as a main motor 2 (FIG. 2) coupled with the support plate 1. Because it is able to rotate, the support plate 1 can be placed into various indexed positions for printing or processing the articles A1 to A32. The support plate 1 is provided on its periphery with a plurality of receiving elements P1 to P32 for articles A1 to A32. As illustrated in FIGS. 1 and 2, the printing device comprises thirty-two articles A1 to A32 respectively mounted on thirty-two receiving elements P1 to P32. The receiving elements P1 to P32 can be distributed angularly in a homogeneous way along the periphery of the support plate 1 having a general disc shape. As illustrated in FIG. 2, the receiving elements P1 to P32 are distributed along a circle C1 at the same distance from the center of the support plate 1 coinciding with the center of the circle C1. Each receiving element P1 to P32 is mounted so as to rotate around its longitudinal axis B, for example via ball bearings. In other words, each receiving element can spin around itself. The rotation of a receiving element P1 to P32 leads to the rotation of an article A1 to A32. Thus, an article A1 to A32 can at the same time spin around itself and around the longitudinal axis B of the receiving element on which it is mounted, and be moved along the circle C1 because of the rotation of the support plate 1. Preferably, the axis of rotation B of the receiving elements P1 to P32 is substantially perpendicular to the longitudinal plane of the support plate 1, i.e. the plane of the sheet in FIG. 2. In the present description, 'substantially perpendicular' means perpendicular with an angle of more or less 10 degrees with respect to a right angle.

Preferably, the receiving elements P1 to P32 are arranged so as to axially receive the respective articles A1 to A32, an article A1 to A32 being associated with a receiving element P1 to P32 supporting it. 'Axially' means that the articles A1 to A32 are arranged on the receiving elements P1 to P32 with their longitudinal axis substantially directed perpendicular to the plane of the support plate 1.

The receiving elements P1 to P32 are designed to ensure a stable and sufficiently precise hold of the articles A1 to A32 during various treatments. For example, if the articles A1 to A32 have a pot shape, the receiving elements P1 to P32 can have a shape following the internal shape of the pots, the pots being arranged on the receiving elements P1 to P32 with their opening turned towards the support plate 1. If the articles A1 to A32 are bottles, the receiving elements P1 to P32 can have a cylindrical shape whose diameter is equal to the internal diameter of the bottlenecks. The receiving elements P1 to P32 can be provided with an expanding system enabling to follow the internal shape of the bottlenecks. A center-punch, not represented here for simplification purposes, bearing on the bottom of an article A1 to A32, can be provided for perfecting the alignment of the longitudinal axis of the article A1 to A32.

The printing device comprises a printing station 30 including four ink jet print heads 22*a* to 22*d*. In addition, the printing device can include another printing station 6 comprising one or two print heads 5*a*, 5*b*. Moreover, the printing device can include one or more printing stations, each of them being provided with at least one print head. The printing device can also comprise other processing stations for the articles A1 to A32, such as a loading station 17 for the articles A1 to A32 on the receiving elements P1 to P32, and an unloading station 18 for the articles A1 to A32. The loading station 17 can be equipped with a gripping arm able to grip an article A1 to A32 from a working station, and to fit the article A1 to A32 gripped into a receiving element P1 to P32 close to the loading station 17. The unloading station 18 can comprise a gripping arm for recovering an article A1 to A32 opposite the unloading station 18. Among the processing stations, one can find successively starting from the loading station 17, an anti-static processing station 19, a surface treatment station 20 (for a corona, flame or plasma treatment), the additional printing station 6, a drying station 21 with ultraviolet radiations, the printing station 30, and another drying station 23 with ultraviolet radiations.

The printing station 30 is preferably a color printing station in which the four print heads 22*a*, 22*b*, 22*c*, 22*d* are respectively associated with the four colors cyan, magenta, yellow and black. Each head 22*a*, 22*b*, 22*c*, 22*d* is preferably associated with only one color for printing a part of a pattern onto an article A1 to A32, in particular a monochromic part of a polychromic pattern. Each head 22*a*, 22*b*, 22*c*, 22*d* can have an independent adjustment of the inclination with respect to the vertical of the support plate 1 so as to follow the profile of an article A1 to A32, in particular when this article has a conical shape. Each print head 22*a* to 22*d*, 5*a*, and 5*b* has many nozzles 40 which are preferably perpendicular to the plane of the support plate 1. The color print heads 22*a*, 22*b*, 22*c*, 22*d* are adjacent so that at each rotation of the support plate 1, in particular when the support plate 1 passes from one indexed position to another, an article A1 to A32 passes successively from one print head to another. The print heads 22*a* to 22*d*, 5*a*, and 5*b* are fixedly mounted on the same base 101. The base 101 forms a support plaque perforated so as to let the support plate 1 through. The plane of the support plate 1 and the plane of the support plaque 101 are preferentially parallel (or substantially parallel).

As illustrated in FIG. 1, the printing device moreover comprises image processing means 31 coupled with the print heads 22*a* to 22*d*, respectively by connections 32 to 35. In a general way, the processing means 31 are configured to generate at least one digital image for printing, via a print head, a part of a pattern onto one or more articles. Preferably, the processing means 31 generate several digital images, for example monochromatic images, respectively for printing the parts of a same pattern, for example a polychromatic pattern.

For example, the print heads of the station 30 can print the monochromic parts of a same initial pattern onto a same article, so that the superposition, the mixture or the juxtaposition of the four monochromic parts onto the article recreate the initial pattern. More particularly, the processing means 31 generate four monochromic digital images respectively cyan, magenta, yellow and black, respectively representing four monochromic parts of a four-color pattern to be printed onto an article. The monochromic digital images are transmitted, by the processing means 31, to the print heads 22*a* to 22*d* so that each print head prints the part of the pattern from the digital image having the color corresponding to that of the print head.

Figure 3:
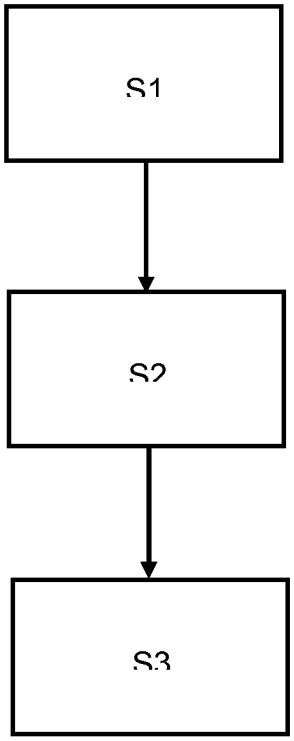
FIG. 3 illustrates in a schematic way the main steps of an embodiment of a printing method according to the invention.

In FIG. 3, it is schematically represented the main steps of an embodiment of a printing method allowing to ensure a precise printing at a high printing speed. The printing method can be implemented by the printing device defined in FIGS. 1 and 2. The method includes a generation step S1 in which for each receiving element P1 to P32 of an article is generated a set of several digital images for respectively printing parts of a same pattern onto the article mounted on the receiving element P1 to P32. For example, for printing a four-color pattern, it is generated for each receiving element an associated set of digital images cyan, magenta, yellow and black for printing the pattern onto an article A1 to A32. Then, during a second step S2, the parts of a same pattern are printed successively onto a same article respectively from the digital images of the set associated with the receiving element for the article.

Thus, all the parts of a pattern are printed onto an article mounted on a receiving element respectively from the digital images of the set associated with the receiving element for the article. For example, by means of the device defined in FIGS. 1 and 2, the support plate 1 positions a first article A1 opposite a first print head 22*a*, the first print head 22*a* prints a first part of a pattern having a first color onto the article A1, in particular simultaneously with a spinning of the receiving element P1 around itself. After printing the first part of the pattern onto the first article A1, the main motor 2 rotate the support plate 1 for positioning the first article A1 opposite another print head 22*b* for printing another part of the pattern having another color. The successive printings onto an article superimpose, mix or juxtapose the parts of the pattern on the article, which recreates the pattern on the article.

In order to increase the printing speed, during each successive printing, several parts of several distinct patterns are printed simultaneously S3 onto several articles, respectively. In particular, each simultaneous printing of a part of a pattern onto an article is performed from a digital image of the set associated with the receiving element for the article.

Preferably, the color print heads 22*a* to 22*d* are positioned relative to one another with an angle with respect to the center of the disc equal to the angle separating two adjacent receiving elements P1 to P32 or to a multiple of this angle of separation. This makes it possible, when one of the print heads 22*a* is opposite a receiving element P1 provided with an associated article A1, to place other articles A3 to A4 opposite the other print heads 22*b* to 22*d*, respectively. In particular, the four print heads 22*a* to 22*d* print simultaneously respectively four monochromic parts of respectively four distinct patterns onto respectively four articles. The four patterns can be identical to or different from each other. Moreover, with each successive printing of a part of a pattern onto an article by means of a first print head 22*a*, three other parts of respectively three other patterns are printed simultaneously onto respectively three other articles by means of the three other print heads 22*b* to 22*d*. In particular, the printing device is particularly adapted for printing several four-color patterns onto several articles A1 to A32 from the four print heads 22*a* to 22*d*.

In other words, four articles A1 to A4 are placed opposite the four color print heads 22*a* to 22*d*, respectively. Then, four parts of four patterns are printed simultaneously respectively onto the four articles. In particular, a first part of a first pattern having the cyan color is printed onto the first article, a second part of a second pattern having the magenta color is printed onto the second article, a third part of a third pattern having the yellow color is printed onto the third article, and a fourth part of a fourth pattern having the black color is printed onto the fourth article, simultaneously. Then, the four articles are moved so that each article is placed opposite another print head in order to print another pattern part onto each article. In particular, each time the articles are moved from one head to another, a printing of a pattern part, so-called successive printing, is performed onto each article. Moreover, for each successive printing, several patterns are printed simultaneously onto several articles, respectively. For example, a step in which an article is dried, preferably by means of ultraviolet radiations, can also be performed after the step in which the parts of a same pattern are printed successively onto the article. It is also possible to perform a step in which each article is partially dried between two simultaneous printing step, i.e. between two printings of respectively two parts of the same pattern onto the article.

In addition, in order to take into account the variations in rotation between the various receiving elements P1 to P32, digital images having a printing format adapted to each receiving element are generated S1. Indeed, for each printing of a pattern part onto an article, the article is rotated via the rotary receiving element. A same receiving element rotates in a same way opposite each print head. For each receiving element, it is then generated an associated set of images having a same length determined from the rotation of the receiving element. In addition, the receiving elements can rotate differently from each other. In particular, the length of the images of the same set associated with a receiving element is determined from the length of an arc described by the rotation of the article mounted on the receiving element. Indeed, when the receiving element is rotated, the article describes for example a full rotation or an arc. In order to obtain a sufficiently precise printing, all the digital images of a same set associated with a receiving element have the same length. The length of a set of images associated with a receiving element can thus be different from that of another set of images associated with another receiving element.

Figure 4:
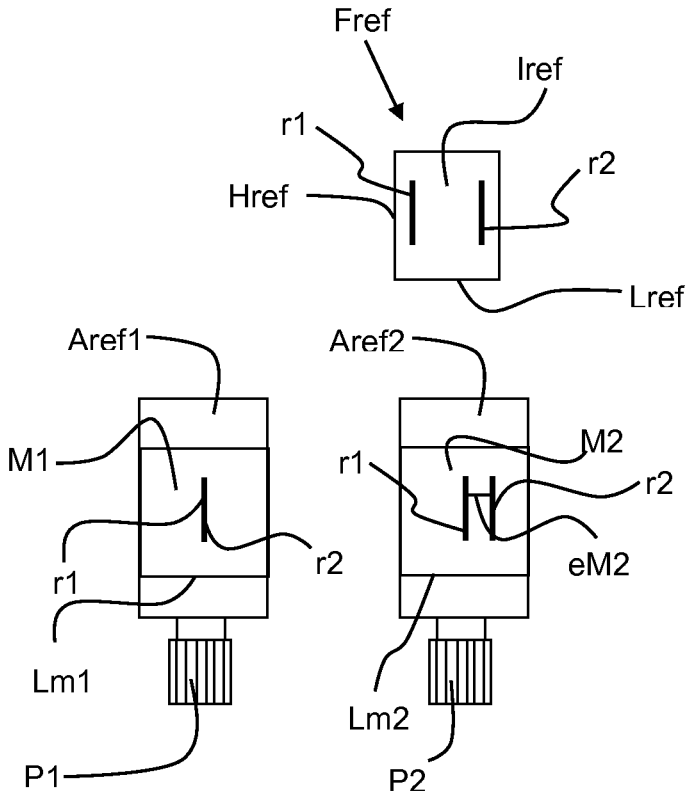
FIG. 4 illustrates in a schematic way an embodiment of a step of determining the length of the digital images.

In order to determine the precise length of the images in each set of images, a step of determining the length of the images is performed before the step of successive printings S2. In FIG. 4 it is schematically represented an embodiment of the step of determining the length of the images. During the step of determining the length of the images, reference articles Aref1 to Aref32 are placed on the receiving elements P1 to P32, respectively. The reference articles can be different from one another, preferentially they are all identical. A reference article can be for example a cylinder, preferably a right cylinder. At least one reference digital image Iref is generated, which has a reference format Fref used by the print heads 22*a* to 22*d*. The reference digital image Iref comprises two marks r1 and r2, and the reference format Fref includes a reference length Lref and a reference height Href. Then, a pattern M1, M2 is printed onto each reference article Aref1, Aref2 from the reference digital image Iref. Then, each pattern printed onto each reference article is analyzed and one determines if a printing error has occurred. For example, one can determine a printing error relative to a mark in the pattern printed onto the reference article, or relative to a mark on the reference article itself. For example, if the pattern is spread out over the article, there is an overlapping of the edges of the pattern on the article. In this case the length of the image is too long. In addition if the pattern is not printed onto the totality of the contour of the article, a non-printed band occurs on the reference article. In this case, the length of the digital image is too short. Once the error is determined, the error determined, associated with the receiving element, is recorded with the help of the image processing means 31, for each receiving element, for example via a software interface of a computer. Then, for each receiving element Pi, a coefficient of correction associated CoefPi is calculated from the determined printing error associated with the receiving element Pi, i.e. from the layout length of the receiving element Pi. It will be noted that the reference Pi indicates a particular receiving element among the receiving elements P1 to P32. Each coefficient of correction Is calculated according to the following relation: CoefPi=(Lref−eMi)/Lref with CoefPi: the coefficient of correction associated with the receiving element Pi;

eMi: the printing error associated with the receiving element Pi; and

Lref: the length of the reference image Iref.

It can be noted in the example illustrated in FIG. 4 that the first pattern M1 is correctly printed because the two marks r1 and r2 are aligned with the pattern M1 printed. In particular, the layout length Lm1 of the first pattern M1 is identical to the reference length Lref. The layout length of a pattern printed onto an article corresponds to the length of the arc described by the contour of the reference article during the rotation of the receiving element of this reference article. The second pattern M2 is not correctly printed, since the layout length Lm2 is greater than the reference length Lref. In this case, one determines a printing error eM2 associated with the second receiving element P2. It can be noted that each receiving element P1 to P32 has a determined layout length, i.e. its own determined rotation which is mechanically reproducible. In other words, the layout length of a receiving element is constant whatever its position in the cycle of use of the printing device, i.e. whatever the indexed position of the support plate 1. Thus, the printing error associated with a receiving element is identical for all the printed patterns whatever the print head used.

For example, one can take:

Darticleref=60 mm: the diameter of each reference article Aref1 to Aref32, and where each reference article has a general shape of a circular cylinder;

Lref=Darticleref·π=188.49 cm: the reference length of the reference image Iref to be printed, for example the reference length is equal to the perimeter of the reference article Aref1 to Aref32; and eM17=+0.72 mm: the printing error associated with the receiving element P17.

In this example, the error eM17 is positive because it corresponds to a printed pattern which is too long with respect to the desired reference pattern which should have a length equal to Lref=188.49. In a general way, the printing error eMi is equal to the difference between the length of the pattern printed onto the reference article and the length Lref of the reference image Iref. It can be noted that the error eMi can be positive, if the layout length of the printed pattern is greater than the length Lref, or negative if the layout length of the printed pattern is less than the length Lref. Moreover, in this example, for the receiving element P17, one calculates the associated coefficient of correction CoefP17=(Lref−eM17)/Lref=(188.49−0.72)/188.49=0.9962.

Then, one determines, for each receiving element P1 to P32, a length LCPi of the associated digital images from the coefficient of correction CoefPi associated with the receiving element. The length LCPi of the images of the set associated with a receiving element Pi is determined by the relation LCPi=LM·CoefPi with LCPi: the length of the digital images of the set associated with the receiving element Pi (Pi being the reference of a receiving element among the thirty-two receiving elements P1 to P32);

LM: the length of an image to be printed;

Thus, from the coefficients of correction CoefPi, a pattern can be printed from a digital image of any length LM onto an article A1 to A32 of any length.

In the example illustrated in FIG. 4, the length LCP1 associated with the first receiving element P1 is equal to the length LM of the image to be printed, because no printing error has been determined, in this case the coefficient of correction CoefP1=1. The length LCP2 associated with the second receiving element P2 is determined as follows: LCP2=LM·CoefP2. As the error eM2 is positive, the length LCP2 is less than the length LM of the image to be printed. In order to automatically determine the lengths of the digital images of each set associated with a receiving element, the length LM of the digital image for printing a pattern onto the articles A1 to A32 is recorded with the help of the processing means 31. Then, the processing means 31 determine, for each receiving element, the length LCPi of the digital images of the set associated with the receiving element Pi, from the length LM of the digital image and the coefficient of correction CoefPi associated with the receiving element Pi.

Figure 5:
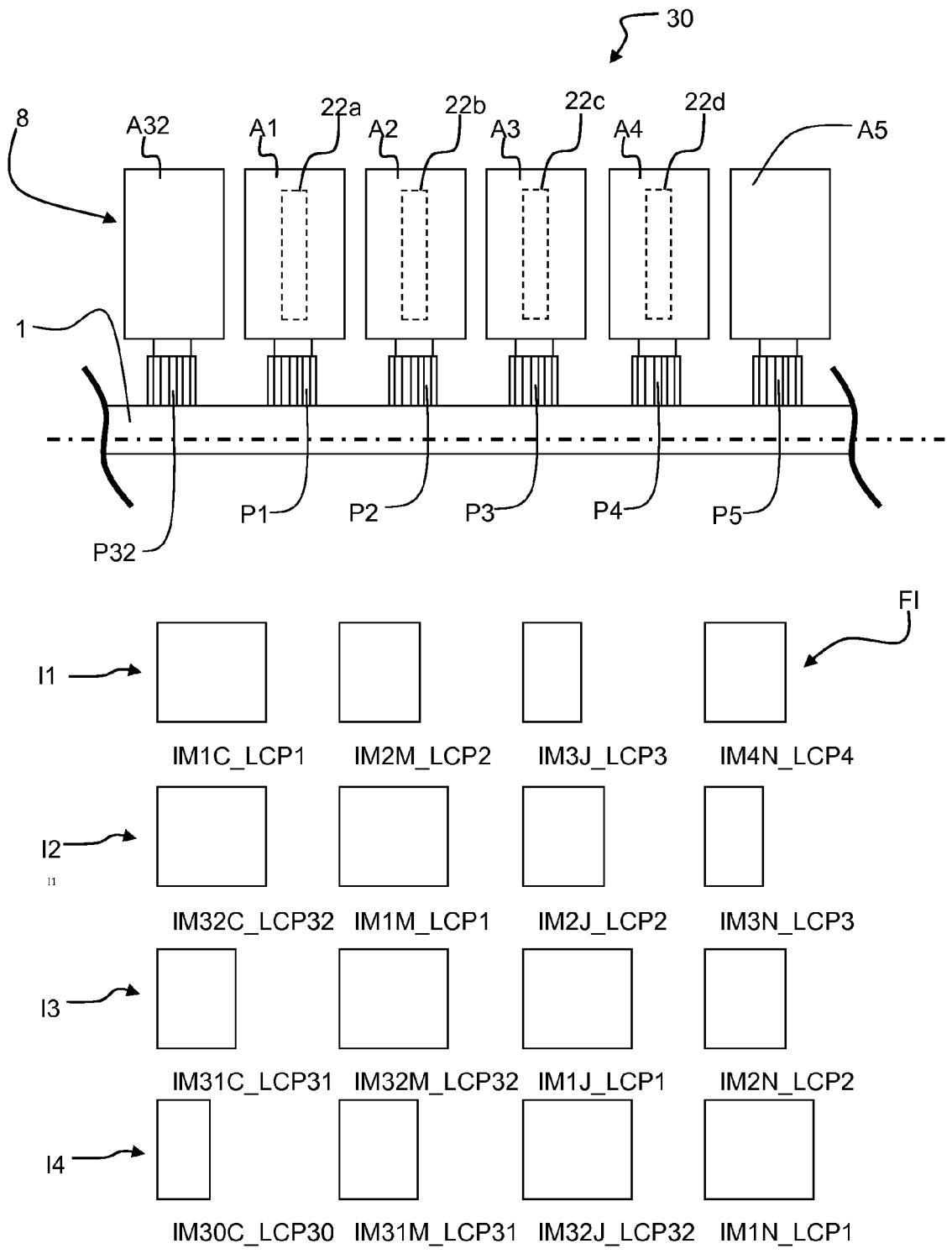
FIG. 5 illustrates in a schematic way another embodiment of the printing method.

In FIG. 5, it is schematically represented a print file FI comprising the various digital images for printing a same pattern, or different patterns, onto the various articles A1 to A32. Each digital image is designated by the general references IMiC_LCPi, IMiM_LCPi, IMiJ_LCPi, and IMiN_LCPi, where i is an integer varying from 1 to 32. IMi corresponds to the reference of the pattern to be printed onto an article mounted on a receiving element Pi, LCPi corresponds to the length of the digital images of the set associated with the receiving element Pi. Consequently, the reference IMiC_LCPi corresponds to the digital image for printing the cyan part of the pattern IMi having the length LCPi, the reference IMiM_LCPi corresponds to the digital image for printing the magenta part of the pattern IMi having the length LCPi, the reference IMiJ_LCPi corresponds to the digital image for printing the yellow part of the pattern IMi having the length LCPi, and the reference IMiC_LCPi corresponds to the digital image for printing the black part of the pattern IMi having the length LCPi. For example the reference IM32J_LCP32 corresponds to the digital image for printing the yellow part of a thirty-second pattern IM32 having the length LCP32 associated with the receiving element P32 which supports the article A32. The first line I1 of the file FI comprises four digital images IM1C_LCP1, IM2M_LCP2, IM3J_LCP3, and IM4N_LCP4. The first digital image IM1C_LCP1 is used by the first print head 22*a* for printing the first cyan part of the first pattern IM1 onto the article A1. It can be noted that the four digital images IM1C_LCP1, IM1M_LCP1, IM1J_LCP1 and IM1N_LCP1 of the set associated with the receiving element P1 have the same length LCP1.

The printing station 30 prints simultaneously four pattern parts IM1C, IM2M, IM3J and IM4N, from respectively the first four digital images of the first line I1, onto respectively the first four articles A1 to A4. The rotation means 2 move the support plate 1 into another indexed position so that the four articles A32, A1 to A3 are placed opposite the adjacent print head. So the thirty-second article A32 is placed opposite the print head 22*a* associated with the cyan color, and the third article A3 is placed opposite the fourth print head 22*d* associated with the black color. Then the printing station 30 prints simultaneously four other pattern parts IM32C, IM1M, IM2J and IM3N from respectively the four digital images of the second line I2 of the file FI. In order to print all the parts of all the patterns IM1 to IM32, the printing station prints successively the lines of the print file FI for each new indexed position of the support plate 1.

The printing method which has just been described can be implemented by the printing device defined in FIG. 1. In order to provide a simultaneous printing of the parts of several distinct patterns and successive printings of all the parts of a same pattern, one can use for example the printing device illustrated in FIG. 2.

In FIG. 2, it is schematically represented a top view of the printing device in FIG. 1. The printing device includes the means 2 for rotating the plate support 1 and a system for rotating the receiving elements P1 to P32. In an initial position, the means 2 for rotating the support plate 1 are configured to place four articles A1 to A4, mounted on their respective receiving elements P1 to P4, respectively opposite the four print heads 22*a* to 22*d* of the printing station 30. 'Opposite' means that a receiving element P1 is close to the print head 22*a* so that the surface of the article A1 mounted on the receiving element P1 can be printed by the print head 22*a*.

The printing device moreover comprises means for generating a relative translation movement between the base 101 and the support plate 1. Advantageously, this movement can be constrained according to a vector between two points distributed along an axis substantially parallel to the axes B of rotation of the articles, in order to enable a helical printing of patterns onto the articles A1 to A32, during the rotation of the receiving elements P1 to P32. In other words, the means for generating the translation movement cooperate with the system for rotating the receiving elements P1 to P32 in order to enable the helical printing.

According to another embodiment, the support plate 1 can be fixed, the base 101 is then provided with a motor able to move it with respect to the support plate 1. If the support plate 1 is fixed, it can be mounted through a total connection on a frame of the printing device. If the base 101 is fixed, it can be mounted through a total connection on the frame of the printing device. 'Total connection between two elements' means that these two elements behave in their movements as a monobloc part.

The system for rotating the receiving elements P1 to P32 comprises a single secondary motor 7 arranged so as to rotate all the receiving elements P1 to P32, via a single belt, or several belts. Each receiving element P1 to P32 comprises a pinion in mesh with a belt.

According to a particular embodiment, the support plate 1 comprises distinct assemblies 8 distributed on the periphery of the support plate 1, and coupled with the secondary motor 7.

Each assembly 8 comprises a series of receiving elements P21 to P24, and a first driving element 9 rotatingly mounted on the support plate 1 and coupled with the secondary motor 7. Preferably, the first driving element 9 has an axis of rotation substantially perpendicular to the support plate 1.

Each assembly 8 moreover comprises an end transmission element 10 in the form of a closed loop, for example a belt. The end transmission element 10 is connected to the receiving elements P21 to P24 of the series and of the first driving element 9 for the assembly concerned, enabling the simultaneous rotation of the first driving element 9, coupled with the secondary motor 7, and of the series of receiving elements P21 to P24. The division into assemblies 8 makes it possible in particular to facilitate the coupling with the secondary motor 7 by limiting the number of transmission elements needed, while maintaining a high speed. In addition, the return to an initial position of the receiving elements P1 to P32 is much faster without having to reverse the direction of rotation of the secondary motor 7. Preferably, the end transmission element 10 of each assembly 8 is arranged so that after each revolution thereof the receiving elements P21 to P24 of the series, and the first driving element 9 associated, take again an identical initial position. To improve the consistency between the various assemblies 8 and the speed, when an end transmission element 10 of an assembly 8 has made a revolution, all the end transmission elements 10 of the various assemblies 8 have preferably also made a loop revolution. In other words, after each revolution of an end transmission element 10, the receiving elements P21 to P24 of each series and the first driving elements 9 associated take again an identical initial position. 'Identical initial position' means that a driving element 9 or a receiving element P1 to P32, has made at least one full revolution about itself, or an integer multiple of revolutions about itself, and is placed again in the same position it had before beginning its revolution.

Preferably, each receiving element P1 to P32 comprises a pinion whose axis of rotation is preferably substantially perpendicular to the plane of the support plate 1. The first driving element 9 is a toothed wheel, and the end transmission element 10 is a toothed belt whose number of teeth is an integer multiple of the number of teeth of each pinion associated, and of number of teeth of the toothed wheel associated. Thus, the teeth of the toothed belt 10 cooperate with the teeth of the toothed wheel 9 and the pinions.

Preferably, the assemblies 8 are connected in twos in order to form distinct unit elements 12. In each unit element 12, the first driving elements 9 of two assemblies joined together are connected to a second driving element 13, preferentially rotatingly mounted on the support plate 1, through an intermediate transmission element 14, in the form of a closed loop such as a toothed belt, so that to each revolution of the intermediate transmission element 14 corresponds a revolution of the end transmission elements 10 of the two assemblies connected together. The second driving element 13 is coupled with the secondary motor 7. The second driving element 13 takes again an identical position after each revolution of the intermediate transmission element 14. Preferably, the second driving element 13 comprises a toothed wheel associated with the intermediate transmission element 14. The toothed wheel can have an axis of rotation substantially perpendicular to the plane of the support plate 1. Preferably, when an intermediate transmission element 14 makes a revolution, all the intermediate transmission elements 14 of the printing device also make a loop revolution. The second driving element 13 has preferably an axis of rotation substantially perpendicular to the support plate 1.

The support plate 1 is preferably a disc, the first driving elements 9 are preferably arranged on a second circle C2 concentric to the first circle C1 and having a diameter less than that of the first circle C1. The second driving elements 13 are preferably arranged on a third circle C3 concentric to the second circle C2 and having a diameter less than that of the second circle C2. The centers of the first, second and third circles C1, C2, C3 coincide with the center of the disc forming the support plate 1. In other words, from the periphery of the support plate, one finds successively in direction of the center of the support plate 1 the receiving elements P1 to P32, the first driving elements 9, the second driving elements 13.

The coupling of the unit elements 12 with the secondary motor 7 can be carried out by connecting them in twos through a main transmission element 15, in the form of a closed loop. Each main transmission element 15 is coupled on the one hand with a third driving element 16 fixed to a central axis driven by the secondary motor 7 and on the other hand with two second driving elements 13 of the unit elements 12. Preferably, the central axis is a shaft of the secondary motor 7. The unit elements 12 are connected so that to each revolution of a main transmission element 15 corresponds a revolution or a half-revolution of the intermediate transmission elements 14 of the unit elements 12 connected, and preferably of all the intermediate transmission elements 14. The third driving element 16 takes again an identical initial position after each revolution of a main transmission element 15. Preferably, to each revolution of an intermediate transmission element 14 corresponds an integer multiple of revolutions of the main transmission element 15 associated. The third driving element 16 has preferably an axis of rotation substantially perpendicular to the support plate 1.

A main transmission element 15 can be formed by a toothed belt. The driving element 16 can comprise a toothed wheel whose axis of rotation is substantially perpendicular to the plane of the support plate 1.

As the end 10, intermediate 14 and main 15 transmission elements have the shape of a closed loop, a 'revolution' made by these elements means a loop revolution. The transmission elements can have the form of belts, preferably toothed belts, or chains.

Preferably, between a first and a second indexed position of the support plate 1, the receiving elements P1 to P32 have made at least one full revolution about themselves. At the first and second indexed positions, in addition to the transmission elements 10, 14, 15, all the driving elements 9, 13, 16 are in their initial position.

According to an embodiment, the printing device comprises eight assemblies 8 angularly distributed on the periphery of the plate 1, and four distinct unit elements 12. Each assembly 8 comprises four receiving elements P21 to P24. Each receiving element P1 to P32 is provided with a 25-tooth pinion 11, and the first driving element 9 of an assembly 8 is formed by a toothed wheel having 25 teeth. The end transmission element 10 associated is a toothed belt having 150 teeth. In other words, when the toothed belt 10 of an assembly makes a revolution, all the receiving elements P1 to P32, and all the first driving elements 9, make exactly six revolutions about themselves. Each second driving element 13 can comprise two toothed wheels whose axis of rotation is preferably perpendicular to the support plate 1. These two toothed wheels are connected together through a total connection, i.e. they are fixed relative to one another, they thus have a same angular velocity. A first 25-tooth wheel of the second driving element 13 is coupled with the intermediate transmission element 14 formed by a toothed belt having 150 teeth. One then obtains in total four unit elements 12. The four unit elements 12 are coupled in twos with the central axis. Each coupling can be carried out by means of a main transmission element 15 in the form of a toothed belt having 150 teeth coupled on the one hand with the second 50-tooth wheels of the second driving elements 13 respectively of the two unit elements 12 connected, and on the other hand with the third driving element 16 preferably arranged in the form of at least one toothed wheel having 50 teeth and fixed to the central axis. There are only two toothed belts forming the main transmission elements 15.

When the belts forming the end transmission elements 10 make a revolution, the belts forming the intermediate transmission elements 14 make a revolution, and the belts forming the main transmission elements 15 make two revolutions.

Such a printing device makes it possible to ensure the reproducibility of the rotational movements of an article on its receiving element for each indexing of the support plate 1.

In particular, in the embodiment in which the receiving elements P1 to P32 are driven by a single belt, the secondary motor 7 is a brushless motor of the driving type. Such a motor enable to avoids the fluctuations of the electric and mechanical losses due to the other types of motor, which would result in introducing not-reproducible shifts for each revolution of the end 10, intermediate 14 and main 15 transmission elements.

During the use of the printing device, each receiving element can have a variation in rotation with respect to another receiving element of the device. Such variations can be due to the variations in the manufacture of the belts and pinions of the driving system for the receiving elements. The printing device defined in FIGS. 1 and 2 is particularly adapted for taking these variations into account and for improving the printing precision of the patterns.

The invention claimed is:

1. A method for printing patterns onto three-dimensional articles respectively mounted on rotary receiving elements, including:

a step of generating, for each receiving element, a set of several digital images for respectively printing parts of a same pattern onto an article mounted on the receiving element, a step of printing successively parts of a same pattern onto a same article respectively from the digital images of the set associated with the receiving element for the article, the digital images of a same set having a same length, and a step of printing simultaneously several parts of distinct patterns respectively onto several articles, each simultaneous printing of a part of a pattern onto an article being performed from a digital image of the set associated with the receiving element for the article.

2. The method according to claim 1, wherein each digital image represents a monochromatic part of a pattern.

3. The method according to claim 2, wherein the length of the digital images of a same set associated with a receiving element is determined from the length of an arc described by the rotation of the article mounted on the receiving element.

4. The method according to claim 1, wherein the length of the digital images of a same set associated with a receiving element is determined from the length of an arc described by the rotation of the article mounted on the receiving element.

5. A device for printing patterns onto three-dimensional articles including:

a printing station provided with several ink jet print heads;

a support plate provided on its periphery with a plurality of receiving elements for articles, each receiving element being rotatingly mounted on the support plate;

image processing means configured to generate, for each receiving element, a set of several digital images for respectively printing parts of a same pattern onto an article mounted on the receiving element; and means for rotating the support plate configured to place each article mounted on a receiving element successively opposite each print head so as to print successively the parts of a same pattern onto a same article respectively from the digital images of the set associated with the receiving element for the article, wherein:

the digital images of a same set having a same length;

the print heads being configured to print simultaneously several parts of distinct patterns respectively onto several articles, and each print head printing a part of a pattern onto an article from a digital image of the set associated with the receiving element for the article.

6. The device according to claim 5, wherein the image processing means generate monochromatic digital images.

7. The device according to claim 6, wherein the image processing means determine the length of the digital images of a same set associated with a receiving element from the length of an arc described by the rotation of the article mounted on the receiving element.

* * * * *